United States Patent [19]

Toon

[11] Patent Number: 4,662,255

[45] Date of Patent: May 5, 1987

[54] PAPER SALVAGE ATTACHMENT FOR PAPER CUTTER

[76] Inventor: Frank L. Toon, 6728 Baron Rd., McLean, Va. 22101

[21] Appl. No.: 793,356

[22] Filed: Oct. 31, 1985

[51] Int. Cl.[4] ..... B26D 7/06

[52] U.S. Cl. ..... 83/104; 83/155; 83/282; 83/456; 83/925 A; 83/262

[58] Field of Search ..... 83/104, 155, 155.1, 83/278, 282, 456, 925 A, 262

[56] References Cited

U.S. PATENT DOCUMENTS

| | | | |
|---|---|---|---|
| 379,736 | 3/1974 | Heckman | 90/19 |
| 2,482,685 | 9/1949 | Moyer | 83/925 A |
| 2,562,938 | 8/1951 | Moyer | 83/255 |
| 2,874,775 | 2/1959 | Muller | 83/925 A |
| 3,207,017 | 9/1965 | McCain | 83/27 |
| 3,250,162 | 5/1966 | Bunting | 83/23 |
| 3,808,931 | 5/1974 | Vulcano | 83/409 |
| 4,505,173 | 3/1985 | Hartlage | 83/104 X |
| 4,506,571 | 3/1985 | Jensen et al. | 83/104 |

OTHER PUBLICATIONS

Challenge Machinery Co., Catalog Adv-4, May 1980.

*Primary Examiner*—James M. Meister
*Assistant Examiner*—John L. Knoble
*Attorney, Agent, or Firm*—Jones, Tullar & Cooper

[57] ABSTRACT

A paper salvage attachment assembly of a paper cutter utilizes a horizontally reciprocable infeed conveyor assembly having an endless conveyor belt which fees bound products to a position beneath the cutting blade of a paper cutter assembly. An outfeed conveyor and stop bar assembly supports the bound product during severance of the spine from the found product. An adjustably positionable stop bar assembly is used to position the vertically reciprocable stop bar at a point downstream of the cutting blade to properly position the bound product so that only its spine will be severed. As the spine is out, the infeed conveyor assembly is retracted away from the paper cutter so that the severed spine may fall through the thus created gap and onto a scrap take away conveyor.

11 Claims, 6 Drawing Figures

PAPER SALVAGE ATTACHMENT FOR PAPER CUTTER

FIELD OF THE INVENTION

The present invention is directed generally to a paper salvage assembly. More particularly, the present invention is directed to a paper salvage attachment for a power operated paper cutter. Most specifically, the present invention is directed to a paper salvage attachment for feeding bound paper products to a paper cutter for spine removal. The bound paper products such as telephone directories, books, and magazines are placed on an infeed conveyor supported on a reciprocating infeed conveyor assembly. The bound products are oriented, aligned, and fed to a power operated power cutter which severs the spine from the bound product. An adjustable stop bar is positioned on the outfeed side of the paper cutter and properly positions the bound products for spine removal. The infeed conveyor frame moves away from the paper cutter during spine removal thus allowing the separated spines to fall onto a waste discharge conveyor. The bound products, whose spines have been removed, are carried away from the paper cutter by the outfeed conveyor once the stop bar has raised. Large volumes of paper can be salvaged quickly and efficiently by the paper salvage attachment while insuring operator safety.

DESCRIPTION OF THE PRIOR ART

Literally millions of books, magazines, paperbacks, manuals, atlases, and the like are printed every year. While some of these are bought and kept or are stored, the bulk of them are eventually discarded as scrap. Additional discards come from printing overruns, printing errors and other such sources. Thus, the number of scrap publications which are awaiting suitable disposal continues to mount. In order to recycle the printed paper thereby reducing costs and preserving natural resources, primarily trees, it is necessary to remove the binding material or the spine from each book. This spine contains glues, binder materials and the like which should not be mixed with the paper to be recycled since these glues and other materials contaminate the paper being recycled.

Several methods and types of apparatus are presently used to sever the spines from books and other bound publications. All of the present systems are slow, dangerous, produce a large amount of dust and noise, or have other serious drawbacks. In one presently used system, books are stacked by hand beneath the cutter blade of a conventional paper cutter. The blade then severs the spines from the books. The operator then removes the cut spines and paper, sorts the materials, places more books under the blade, and repeats the cycle. As will readily be appreciated, this system is not only slow, it is also quite hazardous to the operator. A diligent operator can salvage possibly 500 pounds of books in an hour, a rate which is economically unfeasible. In addition, since the operator must place the books directly under the cutter blade, the risk of loss of fingers or hands is quite high. The required guards, safety interlocks, and the like further reduce the financial feasibility of the operation.

An alternate system of book salvage currently in use is the utilization of a band saw to sever the spines from the books. This system is no faster than the chopper, and has the additional drawbacks of high noise and dust levels. The materials used in the glues found in old books may also be injurious to operator health when inhaled in powder form. Thus vent hoods, noise reduction shielding and the like are required. As with the chopper, these cost factors render book salvaging unprofitable.

While the need exists for a quick, safe, efficient system for salvaging scrap books and other such bound materials for use with a suitable cutting means, no satisfactory solution to the problem has yet been presented. The volume of scrap paper in the form of publications keeps increasing while our natural resource of trees keeps dwindling. Thus there is clearly a need for a better apparatus for feeding bound paper products to a cutter and for separating the severed spines and pages so that they can be recycled.

SUMMARY OF THE INVENTION

It is an object of the present invention to provide a paper salvage assembly.

Another object of the present invention is to provide a paper salvage attachment usable with a power driven paper cutter.

A further object of the present invention is to provide a paper salvage attachment which utilized a reciprocating bound product infeed assembly.

Yet another object of the present invention is to provide a paper salvage assembly having an adjustably positionable bound product stop bar.

Still a further object of the present invention is to provide a remotely operable stop bar assembly.

Yet a further object of the present invention is to provide a paper salvage attachment for a power driven paper cutter which keeps the operator away from the cutter.

Even still another object of the present invention is to provide a paper salvage assembly which is durable, efficient and economical.

As will be discussed in greater detail in the description of the preferred embodiment which is set forth subsequently, the paper salvage attachment for use with a power driven paper cutter includes an infeed conveyor assembly and an outfeed conveyor and stop bar assembly. These two components, which make up the present invention, are usable with any number of power driven paper cutters that are generally well known in the art. A plurality of bound paper products, such as telephone directories, books, magazines and the like, are placed by an operator on the infeed conveyor which is supported on a reciprocating infeed conveyor frame. The bound products are fed to a position beneath the cutter blade of the power driven paper cutter and are stopped by a vertically reciprocable stop bar. The cutter blade then severs the spines from the products. The severed spines fall onto a waste conveyor through a space created by the movement of the infeed conveyor support frame away from the cutter. The now despined paper products are taken away from the cutter by the outfed conveyor. This discharge path is cleared by elevation of the stop bar carried by the adjustably positionable stop bar carriage assembly.

The paper salvage attachment in accordance with the present invention is usable with a large number of various power operated paper cutting devices. The paper salvage attachment is not intended to be a part of the cutter itself but is intended to operate syncronously with the cutter's blade operation. The operator or workman has only to feed bound products to the infeed conveyor from a location remote from the cutter itself. Similarly, the positioning and adjustment of the stop bar and its carriage can be accomplished from a remote location. In this way, the operator or workman does not have to come close to the cutter blade and so has little likelihood of injury. Suitable interlocks and guards can be provided to further minimize any possibility of operator injury, but the paper salvage attachment in accordance with the present invention is structured and operates in a manner which keeps the operator away from the cutting blade.

The spines are severed from the bound products by the reciprocating cutting blade in a clean, efficient manner. There is no generation of white dust as is the case when paper cutting saws are used for spine severance. This elimination of dust provides a cleaner, safer work environment. The severed spines fall onto the waste discharge conveyor while the now despined bound products can be taken away by the outfeed conveyor after the stop bar has been raised. Thus paper salvage of the bound products whose spines have been removed can be conducted in an expeditious manner.

The paper salvage attachment for a paper cutter in accordance with the present invention allows a single operator to remove the spines from a far greater number of bound products in much greater safety and comfort and with little of the dust and danger inherent with prior devices. The paper salvage assembly of the present invention is efficient, durable, safe, can be adapted to a number of power driven paper cutting devices, keeps the operator away from the cutter, and can be quickly removed from the cutter for cutter servicing or repair.

BRIEF DESCRIPTION OF THE DRAWINGS

While the novel features of the paper salvage attachment for a paper cutter in accordance with the present invention are set forth with particularity in the appended claims, a full and complete understanding of the invention may be had by referring to the detailed description of the preferred embodiment, as set forth hereinafter, and as illustrated in the accompanying drawings, in which:

DESCRIPTION OF THE PREFERRED EMBODIMENT

Figure 1:
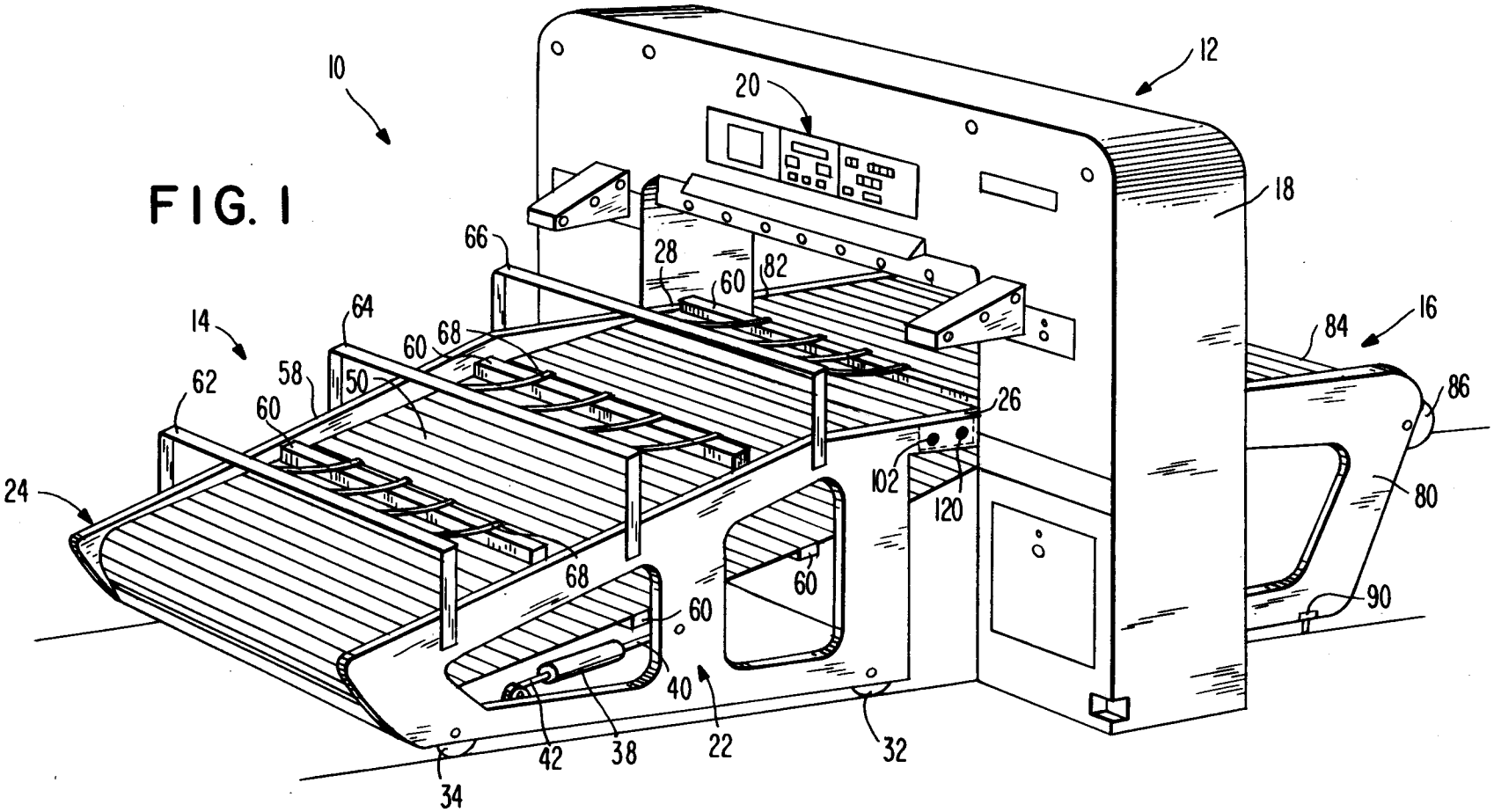
FIG. 1 is a perspective view of the paper salvage attachment in accordance with the present invention in cooperation with a power driven paper cutter.

Referring initially to FIG. 1, there may be seen generally at 10 a preferred embodiment of a paper salvage attachment for a power driven paper cutter, generally at 12, in accordance with the present invention. Paper salvage attachment is comprised of two components, an infeed conveyor assembly, generally at 14, and an outfeed conveyor and stop bar assembly, generally at 16. It will be understood that power driven paper cutter 12 is intended to be representative of a number of commercially available cutter assemblies, all of which are amenable to usage with the paper salvage attachment 10 in accordance with the present invention. By way of general explanation, it will be understood that paper cutter 12 has a generally inverted U-shaped framework 18 which houses conventional hydraulic, pneumatic or electric drive means, control circuitry and the like, none of which forms a part of the present invention and is not shown. Various display components and control switches and the like, generally indicated at 20 are provided to advise the operator of the status and operation of the paper cutter 12.

Figure 2:
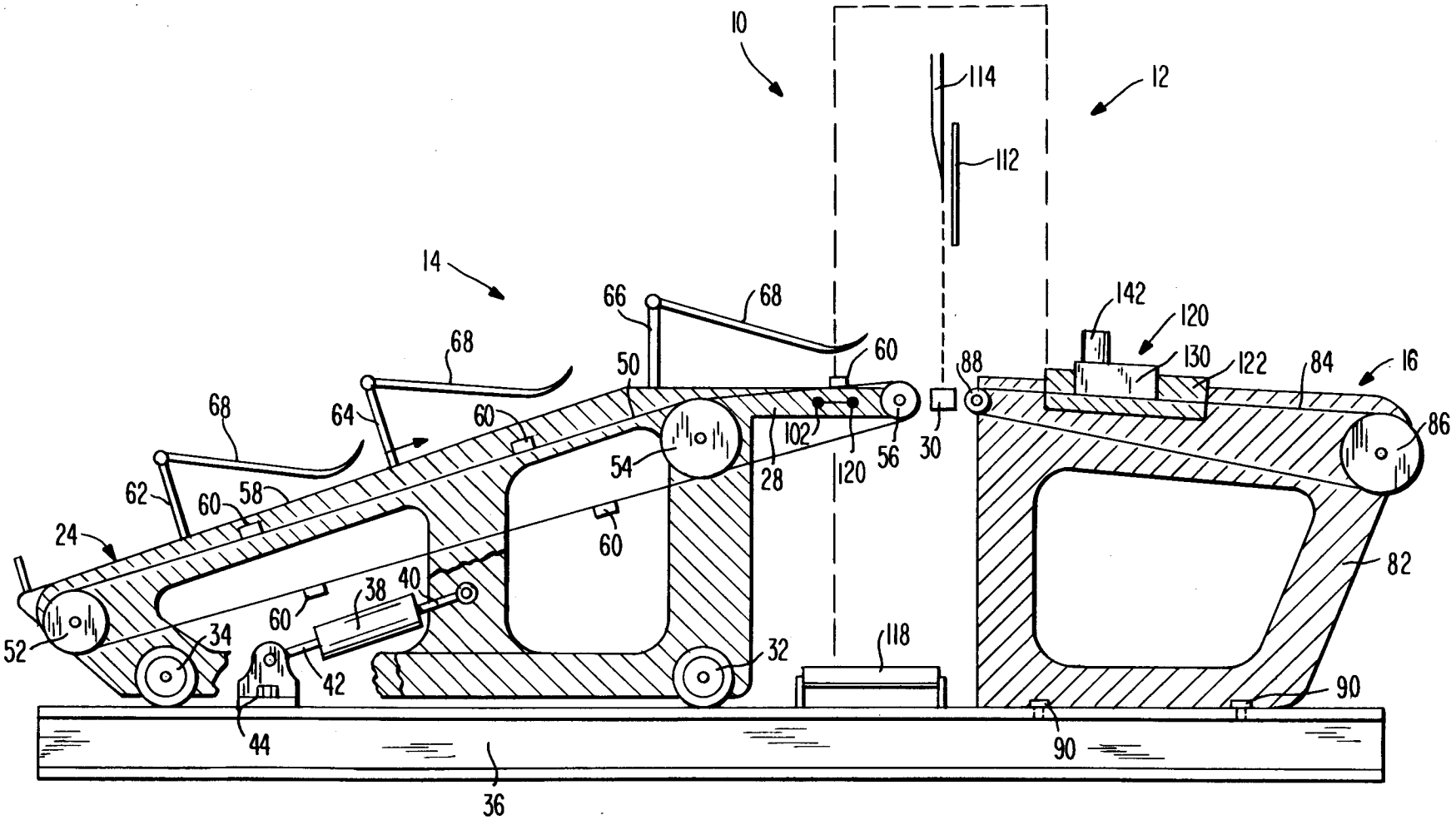
FIG. 2 is a sectional side elevation view of the paper salvage assembly and showing the paper cutter schematically.

Referring now to FIG. 2 in conjunction with FIG. 1, it may be seen that infeed conveyor assembly 14 is formed having a pair of spaced, generally triangular frame plates 22 and 24. Each frame plate 22, 24 includes a cantilever infeed conveyor frame extension 26, 28 with each such cantilever extension being positionable generally adjacent a cutting block 30 of the paper cutter 12, as is shown in FIG. 2. Each infeed conveyor frame plate 22, 24 is equipped with a pair of spaced frame support wheels 32 and 34 which are mounted for rotation on the infeed conveyor frame plates, and which support the infeed conveyor frame assembly for movement on a support frame or base 36. A double acting pneumatic or hydraulic cylinder 38 is supported intermediate each infeed conveyor frame plate 22, 24 and support base 36 by attachment of a piston rod 40 to frame plate 22 or 24 and by connection through a mounting rod 42 to a mounting flange 44 secured to support base 36. Infeed conveyor frame assembly is thus capable of reciprocatory movement toward and away from paper cutter frame 18 on wheels 32 and 34 through the application of suitable hydraulic or pneumatic pressure to the double acting cylinders 38. Although supply and exhaust conduits for the cylinders 38 are not shown, it will be understood that these are conventional and are not shown for the sake of simplicity. Movement of the infeed conveyor frame assembly 24 toward the paper cutter 12 places the ends of the cantilever infeed conveyor frame extensions 26 and 28 adjacent cutting block 30 while movement of the infeed conveyor frame assembly 24 away from the paper cutter 12 separates the ends of the cantilever infeed conveyor frame extensions 26 and 28 from the cutting block 30 by a selectable distance such as, for example 4 to 6 inches.

Again referring to FIGS. 1 and 2, an endless infeed conveyor belt 50 is supported on spaced drive rollers 52 and 54 and idler roller 56, all of which extend between the spaced infeed conveyor frame plates 22 and 24. As is illustrated in FIG. 2, idler roller 56 is attached to the outboard or cantilever ends of the frame extensions 26 and 28, while the drive rollers 52 and 54 are positioned at either end of the generally upwardly inclined sides 58 of the infeed conveyor triangular frame plates 22 and 24. The drive rollers 52 and 54 can be driven by any suitable motor means and may also be adjustably attached to the frame plates 22, 24 to effect belt tension adjustment by any conventional means, not specifically illustrated. A plurality of spaced, transversally extending cross bars 60 are secured to the outer face of infeed conveyor belt 50 and extend thereacross generally parallel to the axes of rollers 52, 54 and 56. Several support bridges 62, 64 and 66 extend between the infeed conveyor side frame plates 22, 24 and above the upper surface of the infeed conveyor belt 50. Each of these support bridges carries a plurality of downwardly and forwarding; i.e. in the direction of travel of conveyor belt 50, extending spring hold down arms 68. The function of these spring hold down arms 68 will be discussed subsequently.

As may also be seen in FIGS. 1 and 2, outfeed conveyor and stop bar assembly 16 includes a pair of spaced, generally parallel, outfeed conveyor frames plates 80, 82 which are generally rectangular. An endless outfeed conveyor belt 84 is positioned between the outfeed conveyor frame plates 80, 82 and is supported by a drive roller 86 and an idler roller 88. Outfeed belt drive roller 86 is driven by any suitable means, not specifically shown, and may also be provided with generally conventional tension adjusting means. The outfeed conveyor frame plates 80, 82 are securely affixed to support frame or base 36 such as by being bolted thereto with bolts 90. These outfeed conveyor frame plates are sized and positioned so that outfeed conveyor belt idler roller 88 is positioned generally adjacent, parallel to, and at the same height as cutting block 30 of paper cutter 12 and on the opposite side thereof from infeed conveyor belt roller 56 supported on cantilever frame extensions 26 and 28.

Figure 3:
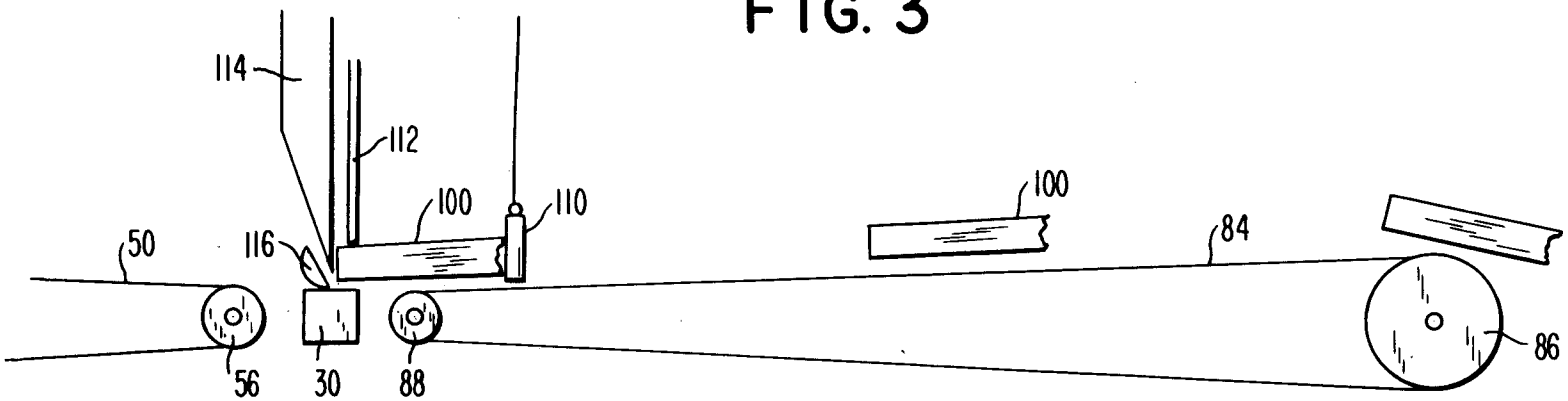
FIG. 3 and FIG. 4 are schematic views of the paper salvage attachment during an operating sequence.
Figure 4:
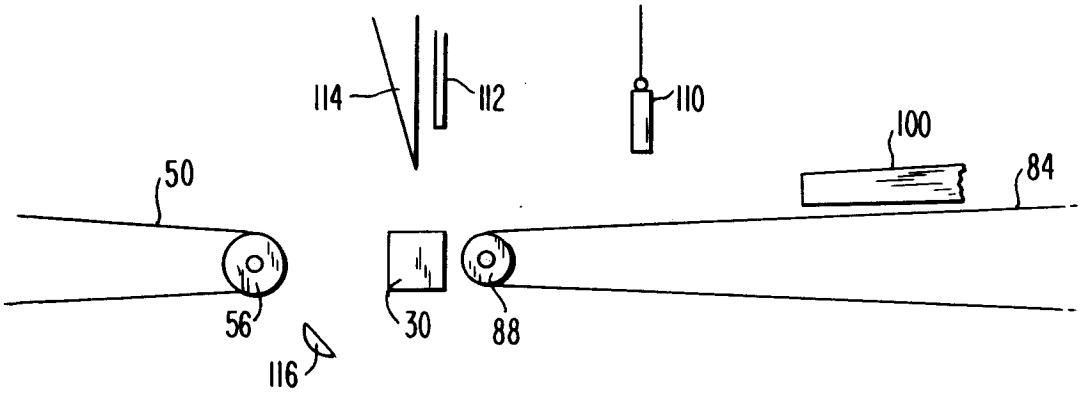

In an operational sequence, as is shown schematically in FIGS. 3 and 4, a plurality of bound products, such as those shown at 100 in FIGS. 3 and 4, are placed by an operator or workman on the surface of infeed conveyor belt 50 generally oriented with their bound portions or spines adjacent a trailing belt cross bar 60. Since the infeed conveyor belt 50 is inclined upwardly as it travels toward the paper cutter 12, as may be seen in FIGS. 1 and 2, the bound products 100 are caused to slide on infeed conveyor belt 50 until their spines contact the trailing cross bar 60. This bound product orientation is also effected by spring hold down arms 68 that also keep the covers of the bound products down. As each belt cross bar 60 passes a sensing means 102, which may, for example, sense a magnet affixed to the ends of the cross bar, a signal is generated which actuates the double acting cylinders 38 to extend piston rods 40 thereby causing the infeed conveyor frame 14 to move on wheels 32, 34 toward the cutter 12 so that the infeed conveyor idler roller 56 is positioned adjacent the cutting block 30. As the infeed belt cross bar 60 passes down around infeed idler roller 56, it forces its bound products 100 across cutting block 30 and onto outfeed conveyor 84. A stop bar 110, which will be discussed in more detail shortly, descends and blocks the travel of bound product 100 so that its spine overlies cutting block 30. In a timed sequence initiated as the infeed conveyor cross bar 60 passes sensing means 102, the infeed conveyor assembly advances toward paper cutter 12, the stop bar 110 descends, a clamping bar 112, which is a component of power driven paper cutter 12, lowers to hold the bound product 100 against the cutting block 30, and a cutter blade 114 of the paper cutter 12 is driven down to sever a spine portion 116 from the bound product 100. During the bound product dwell time against stop bar 110 and while clamp bar 112 is lowering, the hydraulic cylinder 38 is actuated in the opposite direction to retract the infeed conveyor assembly 14 away from the cutting block 30 so that, as may be seen in FIG. 4, there is provided a gap through which the severed spine 116 falls onto a scrap take away conveyor 118 which is shown in FIG. 2. Once the cutting blade 114 reaches the bottom of its travel, the clamp bar 112 raises, as does the stop bar so that the now despined bound product 100 may be conveyed away by outfeed conveyor belt 84 to a suitable point to await further treatment, such as recycling. A bound product sensor 120 is positioned adjacent cross bar sensor 102 to sense the absence of any bound products on infeed conveyor belt 50. If such a condition is sensed, the cutting blade 114 is not lowered thus preventing blade damage. As the next infeed conveyor cross bar 60 passes sensor 102, the cycle is started again. It will be apparent that the forward speed of the infeed conveyor belt 50, the cutting speed of cutter blade 114 and the speed of reciprocation of the infeed conveyor assembly 14 are and coordinated. This may be accomplished by any suitable means which may be interfaced into the existing electronic control assembly for the paper cutter 12 or may be provided as a separate adjunct thereto.

Figure 5:
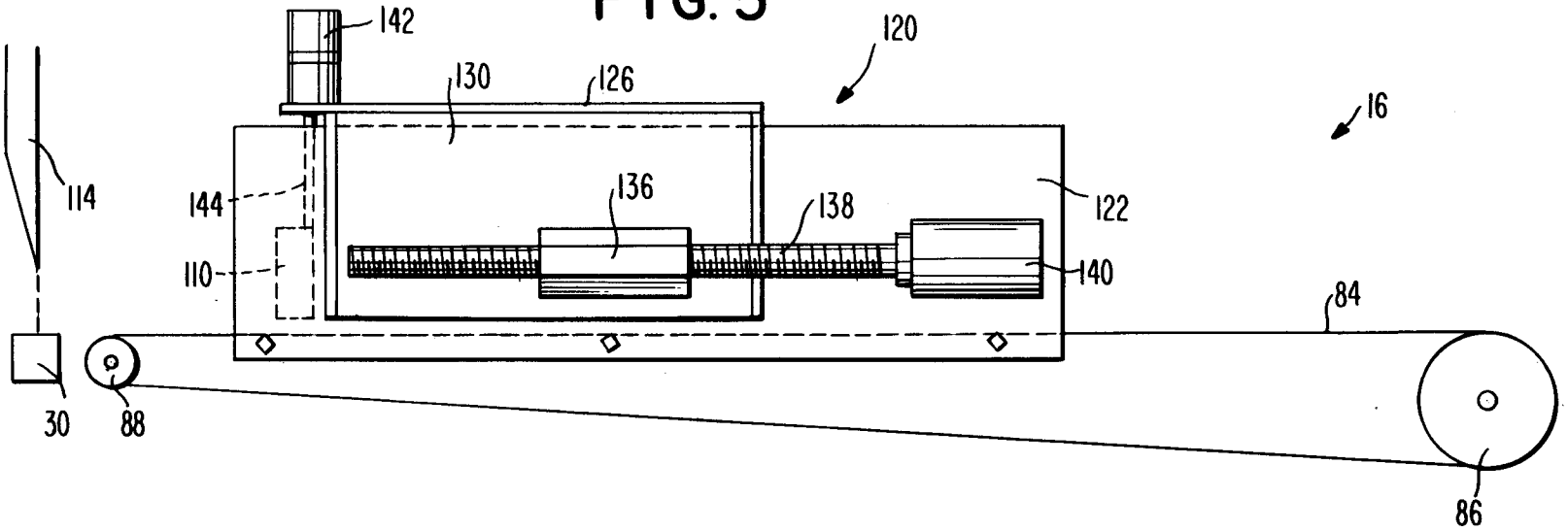
FIG. 5 is a side elevation view of the stop bar and carriage portion of the paper salvage attachment in accordance with the present invention.
Figure 6:
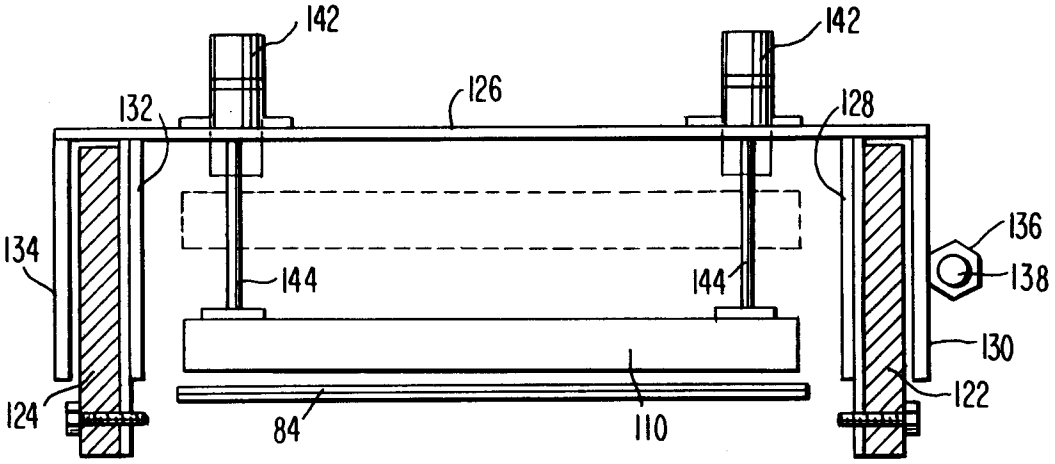
FIG. 6 is a end view of the stop bar and carriage assembly of FIG. 5.

Referring now to FIGS. 5 and 6, it may be seen that stop bar 110 is carried by an adjustably positionable stop bar carriage assembly, generally at 120. A pair of upstanding side plates 122 and 124 are formed as a portion of the outfeed conveyor and stop bar assembly frame plates, 80 and 82. These spaced side plates 122, 124 are positioned on either side of the outfeed conveyor belt 84 and extend generally vertically thereabove. Stop bar carriage assembly 120 includes a generally horizontal planar support platform 126 that carries downwardly depending inner and outer guide flange pairs 128, 130 and 132, 134, respectively. Each guide flange pair 128, 130 and 132, 134 encompasses its corresponding upstanding side plate 122, 124, respectively, as may be seen most clearly in FIG. 6. A threaded bushing 136 is attached to outer guide flange 130 and receives a threaded lead screw 138. The lead screw 138 is rotated by a suitable drive motor 140 that is attached to upstanding side plate 122. Thus it may be seen that the stop bar carriage assembly 120 is movable generally in a horizontal direction toward or away from cutter blade 114 by actuation of motor 140. Since the motor 140 is securely affixed to the stationary upstanding side plate 122, rotation of the lead screw 138 in the threaded bushing 136 will cause horizontal planar support platform 126 to slide along side plates 122 and 124 while being guided by the overlayment of the side plates 122 and 124 by the guide flange pairs 128, 130 and 132, 134.

Stop bar 110 is supported for vertical movement adjacent the leading edge of horizontal planar support platform 126 of stop bar carriage assembly 120, as may be seen most clearly in FIG. 6. A pair of spaced hydraulic or pneumatic cylinders 142 are affixed to the upper surface of horizontal planar support platform 126. Each of these cylinders 142 has a downwardly extending piston rod 144 which is secured at its lower end to the top of stop bar 110. Operation of the cylinders 142 thus raises and lowers the stop bar 110 which acts as a bar to the passage of a bound product 100 during spine removal by cutter blade 114. The raising and lowering of the stop bar 110 is also controlled with respect to the cutter blade 114 and clamp bar 112 so that the stop bar 110 will stop the forward travel of the bound product 100 before the clamp bar 112 lowers. Proper horizontal positioning of the stop bar 110 is effected by actuation of the lead screw drive motor 140. This positioning can be accomplished by the operator or workman at a remote location. Once the positioning of stop bar 110 with respect to cutter blade 114 has been effected by positioning of stop bar carriage assembly 120, there is no further need to move the stop bar carriage assembly 120 until the size of the bound product 100 changes.

In operation, the bound products 100, whose paper is to be salvaged, are loaded on infeed conveyor belt 50 by an operator or workman. These bound products 100 are placed with their spines against a trailing cross bar 60 and are carried forwardly and upwardly to paper cutter 12. The cantilever portion of infeed conveyor 14 is positioned adjacent a first side of cutting block 30 so that the bound products 100 can be moved across beneath cutting blade 114 and onto outfeed conveyor 84 where their forward travel is halted by lowered stop bar 110. At this point, the clamp bar 112 lowers and the infeed conveyor assembly 14 rolls back on wheels 32 and 34 due to the actuation of double acting cylinders 38. The paper cutter blade 114 falls and severs the spine 116 from the bound product 100, with the severed spine falling through the gap between cutter block 30 and the retracted infeed conveyor assembly 14 onto a scrap take away conveyor 118. The stop bar then raises to allow the bound product 100, whose spine has been removed, to pass beneath the stop bar carriage assembly 120 on outfeed conveyor belt 84. The infeed conveyor assembly 14 again moves forwardly to again place idler roller 56 adjacent cutting block 30 and to transfer the next group of bound products 100 beneath the cutter blade 114.

The paper salvage attachment for a paper cutter in accordance with the present invention, as has been discussed above, is usable with various paper cutters and does not require substantial modifications thereto. The paper salvage attachment keeps the workman or operator away from the actual cutting blade during spine removal. Remote positioning of the stop bar 110 allows the attachment to be used with various sized bound products. The attachment is durable, efficient, not expensive to install or operate, and facilitates the removal of the spine portions from large numbers of bound products so that substantial quantities of scrap paper can be reclaimed.

While a preferred embodiment of a paper salvage attachment for a paper cutter has been fully and completely described hereinabove, it will be obvious to one of skill in the art that a number of changes in for example, the specific paper cutter, the type of conveyor belt, the specific drive motors, and the like could be made without departing from the true spirit and scope of the present invention which is accordingly to be limited only by the following claims.

What is claimed is:

1. A paper salvage attachment usable with a paper cutter having a reciprocable cutter blade and cooperating fixed cutting block and a clamp bar for holding a bound product during spine removal, said paper salvage attachment comprising:

a reciprocating infeed conveyor assembly supported for reciprocable movement by support wheels which engage a support frame, said infeed conveyor assembly having an endless bound product infeed conveyor belt which passes about a cantilever frame end which is reciprocably positionable adjacent a first side of the cutting block of the paper cutter;

an outfeed conveyor assembly positioned adjacent a second side of the cutting block of the paper cutter and including an endless outfeed conveyor belt a vertically reciprocable stop bar carried by a positional stop bar carriage assembly which is positioned above and across said outfeed conveyor belt, said stop bar being reciprocable to descend from said carriage assembly to block passage of a bound product along said outfeed conveyor belt during spine removal;

means to reciprocate said infeed conveyor assembly toward and away from the paper cutter and including at least a first double acting cylinder affixed at a first end to said wheeled infeed conveyor assembly and at a second end to said support frame; and means to position said stop bar carriage assembly longitudinally along said outfeed conveyor belt with respect to the second side of the cutting block of the paper cutter to thereby longitudinally position said vertically reciprocable stop bar above said outfeed conveyor belt.

2. The paper salvage attachment of claim 1 wherein said infeed conveyor assembly includes spaced frame plates, said infeed conveyor belt being supported and driven by spaced infeed drive and idler rollers extending between said spaced infeed conveyor frame plates.

3. The paper salvage attachment of claim 1 wherein said infeed conveyor belt includes a plurality of spaced cross bars, each of said cross bars extending across said infeed conveyor belt generally transverse to the direction of travel of said infeed conveyor belt.

4. The paper salvage attachment of claim 2 wherein a plurality of spaced support bridges extend between said spaced frame plates above said infeed conveyor belt and generally transverse to the direction of travel of said infeed conveyor belt.

5. The paper salvage attachment of claim 4 wherein each said support bridges carries a plurality of downwardly and forwardly, in the direction of travel of said infeed conveyor belt, extending hold down arms.

6. The paper salvage attachment of claim 1 wherein said outfeed conveyor assembly includes a pair of spaced outfeed conveyor frame plates, said outfeed conveyor belt being supported and driven by spaced outfeed drive and idler rollers extending between said outfeed conveyor frame plates.

7. The paper salvage attachment of claim 6 wherein said stop bar carriage assembly includes a planar support frame having downwardly extending inner and outer guide flange pairs.

8. The paper salvage attachment of claim 7 wherein each of said spaced outfeed conveyor frame plates includes an upwardly extending side plate, said inner and outer guide flange pairs straddling said side plates.

9. The paper salvage attachment of claim 8 wherein one of said outer guide flanges carries a threaded bushing, said threaded bushing receiving a threaded lead screw driven by a lead screw drive motor affixed to said side plate being straddled by said bushing carrying outer guide flange and its cooperating inner guide flange, whereby actuation of said lead screw drive motor causes said stop bar carriage assembly to move relative to said spaced outfeed conveyor frame plates.

10. A paper salvage attachment usable with a paper cutter having a reciprocable cutter blade and cooperating fixed cutting block and a clamp bar for holding a bound product during spine removal, said paper salvage attachment comprising:

an infeed conveyor assembly, said infeed conveyor assembly having an endless bound product infeed conveyor belt which passes about a cantilever frame end positionable adjacent a first side of the cutting block of the paper cutter;

an outfeed conveyor and stop bar assembly positioned adjacent a second side of the cutting block of the paper cutter, said outfeed conveyor and stop bar assembly including a pair of spaced outfeed conveyor frame plates, an outfeed conveyor belt supported and driven by spaced outfeed drive and idler rollers extending between said outfeed conveyor frame plates, and a vertically reciprocable stop bar carried by a positionable stop bar carriage which includes a planar support frame having downwardly extending inner and outer guide flange pairs;

an upwardly extending side plate secured to each of said spaced outfeed conveyor plates, said inner and outer guide flange pairs straddling said side plates, one of said outer guide flanges carrying a threaded bushing, said threaded bushing receiving a threaded lead screw driven by a lead screw drive motor affixed to said side plate being straddled by said bushing carrying outer guide flange and its cooperating inner guide flange, actuation of said lead screw drive motor causing said stop bar carriage to move relative to said spaced outfeed conveyor frame plates to position said stop bar carriage along said outfeed conveyor belt with respect to the second side of the cutting block of the paper cutter; and means to reciprocate said infeed conveyor assembly toward and away from the paper cutter.

11. The paper salvage attachment of claim 10 wherein said planar support frame carries spaced stop bar reciprocating cylinders having extendable and retractible stop bar engaging piston rods whereby actuation of said stop bar reciprocating cylinders raises and lowers said stop bar.

* * * * *